US006129090A

United States Patent [19]

Pillar et al.

[11] Patent Number: 6,129,090

[45] Date of Patent: Oct. 10, 2000

[54] TOOTHBRUSH STORAGE CAP WITH INTEGRAL STORAGE OF DENTAL FLOSS

[76] Inventors: Charles Jay Pillar, 140 Plainview Rd., Woodbury, N.Y. 11797; Laura Ann Pillar, 525 N. Park Ave., Bloomington, Ind. 47408

[21] Appl. No.: 09/460,015

[22] Filed: Dec. 13, 1999

[51] Int. Cl.[7] ..... A45D 44/18

[52] U.S. Cl. ..... 132/309; 206/362.3; 15/184; D4/113

[58] Field of Search ..... 132/309, 308, 132/311; 206/362.3, 15.3; 15/184; D3/205; D4/113

[56] References Cited

U.S. PATENT DOCUMENTS

| | | | |
|---|---|---|---|
| 1,470,129 | 10/1923 | Tichenor | 132/308 |
| 2,662,535 | 12/1953 | Alboreo et al. | 15/184 |
| 2,968,827 | 1/1961 | Lawsine et al. | 15/184 |
| 5,040,553 | 8/1991 | Londono et al. | 132/311 |
| 5,052,556 | 10/1991 | Wilkinson | 132/308 |
| 5,779,046 | 7/1998 | Plakos | 206/362.3 |
| 5,832,940 | 11/1998 | Embry et al. | 132/309 |
| 6,009,886 | 1/2000 | Labranche et al. | 132/309 |
| 6,026,532 | 2/2000 | Catanzaro | 132/308 |

*Primary Examiner*—Todd E. Manahan
*Attorney, Agent, or Firm*—Brian K. Dinicola

[57] ABSTRACT

A reuseable toothbrush cap assembly which defines a first compartment dimensioned and arranged to substantially enclose and protect the bristle portion of a toothbrush while allowing the graspable handle portion of the toothbrush to extend outside the compartment such that the toothbrush may continue to be stored in a conventional toothbrush holder. The toothbrush cap assembly further defines a second compartment dimensioned and arranged to receive a spool of dental floss, and a cutter dimensioned and arranged proximate an opening in the second compartment through which dental floss may be withdrawn to thereby allow cutting of the same into a segment of desired length.

15 Claims, 3 Drawing Sheets

TOOTHBRUSH STORAGE CAP WITH INTEGRAL STORAGE OF DENTAL FLOSS

BACKGROUND OF THE INVENTION

1. Field of the Invention

The invention relates to oral hygiene products, and in particular, to reusable toothbrush storage caps.

2. Discussion of the Background Art

It has been known for many years that the two most essential elements of good dental hygiene are the daily brushing and flossing of one's teeth. In most households, toothbrushes are kept in some form of holder with openings dimensioned and arranged to maintain each toothbrush in an upright orientation so that they may be quickly and conveniently retrieved when needed. The holder may be a free standing object designed to be supported by an underlying vanity or cabinet surface, or it may be attached to a vertical surface such as a wall. In either case, when stored in this manner the bristles of a toothbrush are exposed to the air so as to be completely unprotected from airborne contamination by microscopic organisms. Given the location—precisely where one would expect to find a large concentration of germs, such a means of storage would seem ill advised to say the least.

While the price of convenient "out-in-the-open" accessibility to one's toothbrush may be an increased risk of infection from airborne bacteria, it may be also said that it is a lack of such accessibility which is the biggest impediment to the equally important step of flossing. That is, unlike the toothbrush, the roll of dental floss—if present at all—is typically relegated to an obscure shelf of the bathroom medicine cabinet. As a result, the flossing step is frequently overlooked altogether despite its well documented role in the prevention of periodontal disease.

Various approaches have been proposed in efforts to protect the bristles of a toothbrush, particularly while traveling. See, for example, U.S. Pat. No. 4,835,813 (Lorenzana), U.S. Pat. No. 5,044,039 (Picard), U.S. Pat. No. 5,048,144 (Andrews), and U.S. Pat. No. 5,052,556 (Wilkinson). The toothbrush storage caps disclosed in the aforementioned patents are designed to fit over the head of the toothbrush, and protect the toothbrush bristles from dirt, grime and damage. The prior art includes reusable toothbrush storage caps, as well as disposable toothbrush covers. Reusable toothbrush storage caps are typically made from molded plastic (e.g., molded polypropylene. While caps of the aforementioned type may adequately protect the bristles of a toothbrush from contamination by airborne bacteria, they do not address the need to facilitate flossing.

In view of the foregoing, it will be appreciated that a need continues to exist for a cover assembly which not only facilitates the continued accessibility of the toothbrush by protecting the bristles from open air exposure, but which also extends the beneficial aspect of accessibility to the dental floss to thereby increase the likelihood that the user will perform both of the essential daily steps of dental hygiene.

SUMMARY OF THE INVENTION

The aforementioned need is addressed, and an advance is made in the art, by a reuseable toothbrush cap assembly which defines a first compartment dimensioned and arranged to substantially enclose and protect the bristle portion of the brush while allowing the handle portion to extend outside so as to permit the brush to be maintained in a substantially upright position by a conventional toothbrush holder. The toothbrush cap assembly of the present invention further includes a second compartment dimensioned and arranged to receive a spool of dental floss, and a cutter dimensioned and arranged proximate an opening in the second compartment through which dental floss is withdrawn to thereby allow cutting of the floss into a segment of desired length.

In accordance with a preferred embodiment of the invention, the first and second compartments of the storage cap are arranged such that the second compartment is disposed above said first compartment when the storage cap is positioned over the bristles of a toothbrush in the substantially vertical position. To this end, the first compartment is defined by a first section of the storage cap and the second compartment is defined by a second section of the storage cap, the first and second sections being hingedly coupled to permit access to the second compartment for insertion of a spool of dental floss. It should, of course, be understood that instead of being arranged as upper and lower compartments in the storage cap, the first and second compartments might be configured in some other manner as, for example, by arranging one in front or behind the other.

To protect the dental floss and blade, the storage cap of the present invention preferably includes a lid that is manipulable between a first position covering at least the opening and cutter and a second position exposing the opening and cutter to thereby permit removal of a segment of dental floss. In an especially preferred form of the invention, the entire storage cap is integrally molded as a single, unitary structure from a suitable plastic material such, for example, as polypropylene. In such event, the lid can be advantageously attached to the main body of the storage cap by a living hinge.

In accordance with an especially preferred embodiment of the present invention, the exterior surfaces of the storage cap are dimensioned and arranged to form a shape representative of a healthy human tooth. To this end, the upper surface of the lid may be provided with an undulating contour suggestive of the upper surface of a tooth while the lower surfaces of the storage cap may be configured in a diverging manner, with arcuate recesses defined on opposed lateral sidewalls so as to be representative of the roots of a tooth.

BRIEF DESCRIPTION OF THE DRAWINGS

The various aspects, features and advantages of the invention may be better understood by those skilled in the art by reference to the detailed description that follows, taken in conjunction with the drawings, in which.

DETAILED DESCRIPTION OF THE INVENTION

Figure 1:
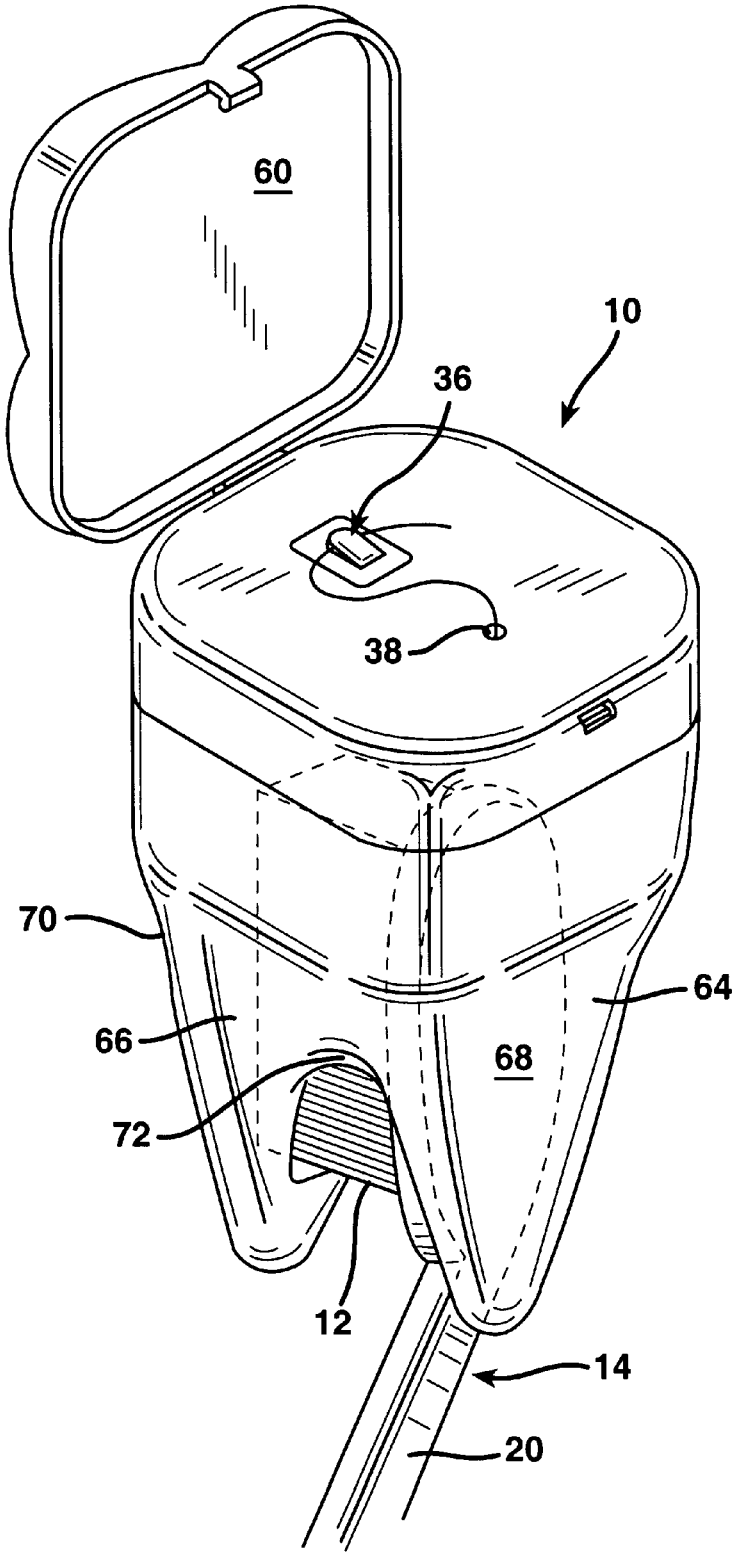
FIG. 1 is a perspective view of a reusable toothbrush storage cap in accordance with an illustrative embodiment of the invention, the bristle portion of a toothbrush being shown in phantom to depict its orientation within a first compartment of the storage cap during use.

FIG. 1 shows a reusable toothbrush storage cap 10 in accordance with an illustrative embodiment of the invention being used to protect the bristles 12 of a toothbrush 14, and to retain a spool of dental floss so that the latter is as readily accessible and convenient to use as the toothbrush. To this end, the reusable toothbrush storage cap 10 includes a first compartment 16 dimensioned and arranged to receive and substantially enclose the bristles 12 and a second compartment 18 (FIG. 2) dimensioned and arranged to receive the spool of dental floss 19. As seen in FIG. 1, at least the lower portion of the graspable handle 20 of toothbrush 14 is external to the first compartment. Advantageously, this permits a toothbrush equipped with the storage cap 10 of the present invention to be stored in a conventional stationery toothbrush holder (not shown) of the type defining one or more vertical apertures dimensioned and arranged to accommodate insertion of the handle without admitting the bristles. Accordingly, the user may continue to store the toothbrush in a convenient and, more specifically, a conspicuous location to thereby promote a daily regimen of brushing and flossing.

Figure 2:
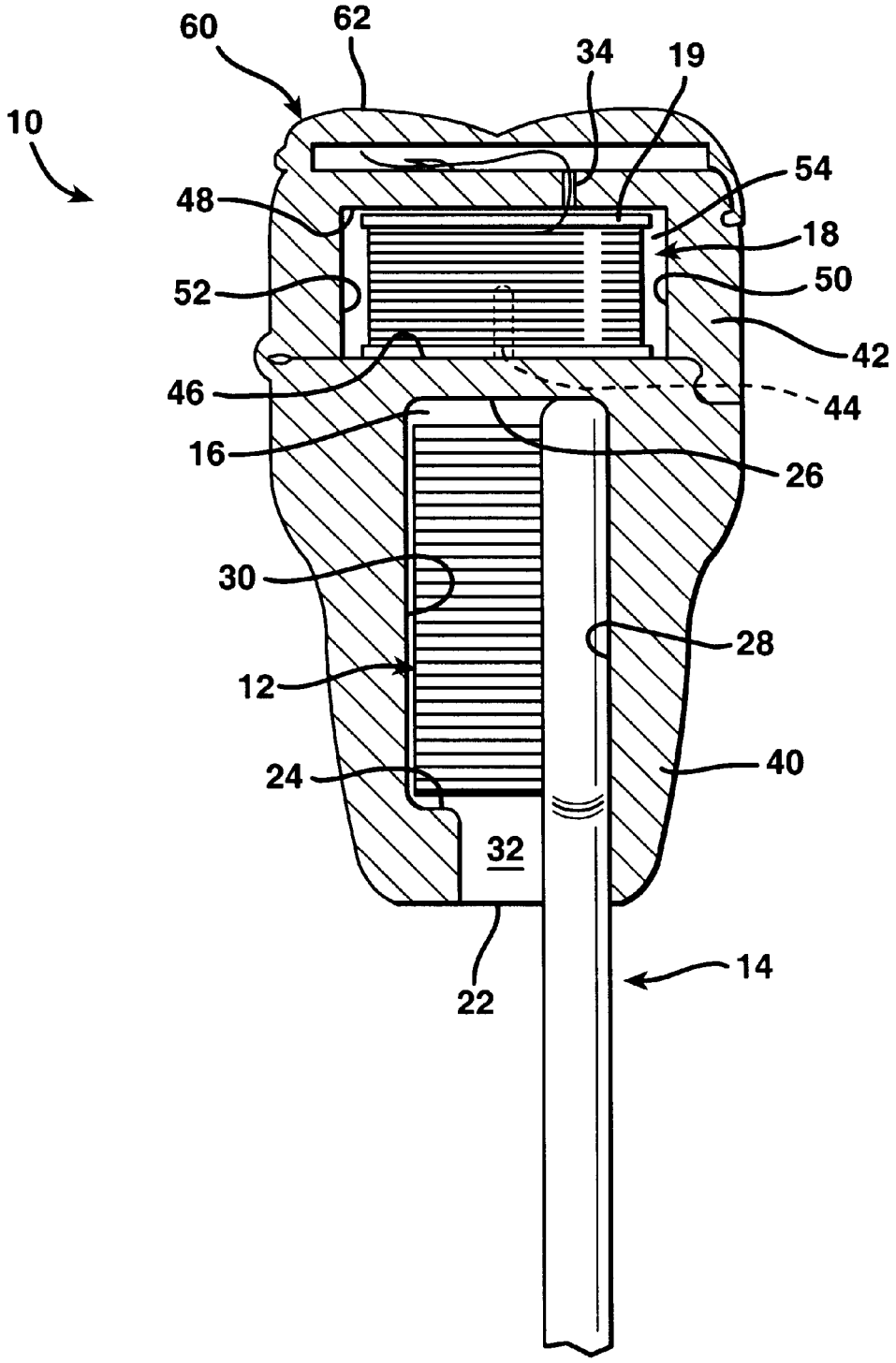
FIG. 2 is a side elevation view of the reusable toothbrush storage cap shown in FIG. 1.

With continued reference to FIG. 1, it will be seen that storage cap 10 has a small opening 22 at the bottom dimensioned to accommodate insertion of the bristled head of the toothbrush. As best seen in FIG. 2, the lower interior surface 24 of first compartment 16 defines an abutment dimensioned to support the lower bristles of toothbrush 14 following insertion of the bristles. It should, however, be pointed out that a wide variety of compartment configurations may be employed without departing from the spirit and scope of the invention. For example, if one were concerned that repeated insertion of bristles 12 through a narrow opening (as the bottom opening 22 depicted in FIGS. 1 and 2) would cause premature wear on the bristles, first compartment 16 of storage cap 10 may be additionally provided with a second opening (not shown) in one of the sidewalls. Such an arrangement would allow toothbrush 12 to be inserted through first compartment 16, handle first, by directing the graspable handle 20 through the second opening first and then through opening 22. Of course, it would be necessary to cover such a second opening with a suitable lid (not shown), in order to maintain the integrity of first compartment 16 when the toothbrush is to be stored again.

With continued reference to FIG. 2, it will be seen that first compartment 16 is defined by a lower interior surface wall 24, an upper interior surface 26, a front interior surface 28, and a rear interior surface 30, as well as a first and second opposed longitudinal side wall surfaces, only one of which, generally indicated at 32, being visible due to the cross sectional nature of FIG. 2. The front and rear interior surfaces, and the longitudinal side wall surfaces are contiguous with one another and extend upward from lower interior surface 24 to upper interior surface 26. Venting and drainage is accommodated through bottom opening 22.

Figure 3:
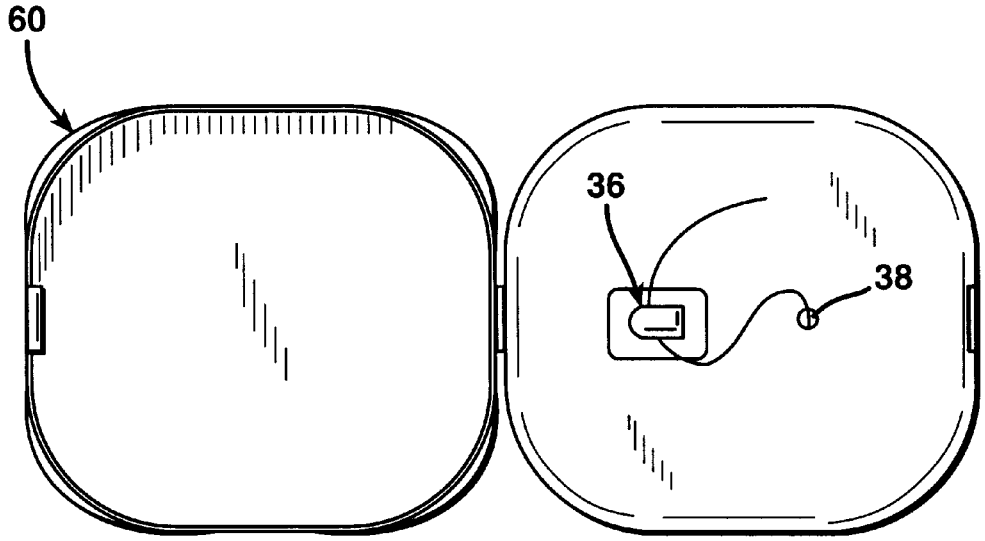
FIG. 3 is a top plan view of the reusable toothbrush storage cap shown in FIG. 1, with the lid being opened to expose a cutter and an end section of dental floss withdrawn from a second compartment of the storage cap.
Figure 4:
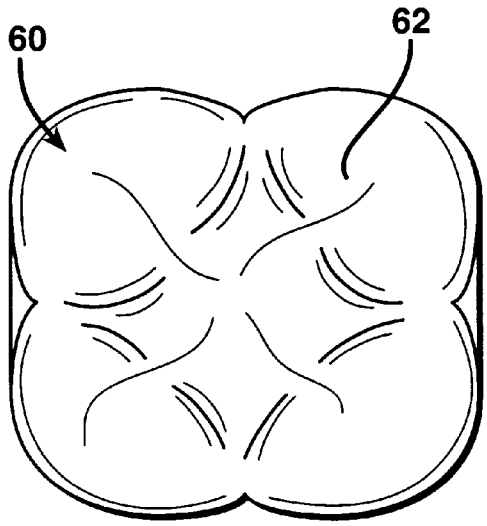
FIG. 4 is a top plan view of the reuseable toothbrush storage cap shown in FIG. 1, the lid being in a closed position protecting the cutter and associated section of dental floss.

In addition to the protection of toothbrush bristles as described above, a principal objective of the present invention is to provide a convenient way of retaining dental floss to enhance the likelihood of its use. To this end, and as best seen in FIG. 2, it will be seen that second compartment 18 is dimensioned to receive and retain a spool of dental floss 19, the compartment providing sufficient clearance on all sides to allow spool 19 to rotate freely as floss is withdrawn through exit path 34. As seen in FIGS. 1 and 3, a cutter 36 is positioned adjacent to the discharge opening 38 of exit path 34 so that after the user has withdrawn a section of floss, a segment of desired length may then be severed for use.

Returning once again to FIG. 2, it will be seen that in the illustrative embodiment of the present invention, the respective compartments 16 and 18 are defined in corresponding first and second sections, indicated generally at 40 and 42, of storage cap 10. The first or lower section 40 includes respective side walls which define the interior surfaces of compartment 16 as described previously, as well as an upper partition wall 44 which isolates the respective compartments from one another. The upper surface 46 of partition wall 44 serves as the lower surface of second compartment 18. Accordingly, the second or upper section 42 defines only an upper interior surface 48, front and rear interior surfaces 50 and 52, respectively, and lateral interior surfaces (only one of which, indicated generally at 54, being shown due to the cross sectional nature of FIG. 2).

Although the first and second sections of the storage cap may be secured to one another in any desired manner (or may even be molded together as a common structure with access to the second compartment being accommodated in a manner similar to that described above in connection with the insertion of the graspable handle through the first compartment), in an especially preferred form of the invention and as depicted in the illustrative embodiment of FIG. 2, the first and second sections are connected to one another by a living hinge. Thus, to replace a spool of dental floss 19, one need only manipulate the second section so as to expose the interior of second compartment 18, remove the old spool from the upper surface of partition wall 44, place a new spool onto surface 46, and feed the free end of the dental floss through exit path 34. Second section 42 may then be snap fit back into place and storage cap 10 returned to duty. Optionally, surface 46 may be configured with an upwardly directed pin or other projection (not shown) dimensioned to extend through an axial opening in the spool 19. Such a pin would not interfere with the requisite rotary motion of spool 19 as floss is paid out, but would simplify floss spool replacement operation by preventing sliding of the spool while the leading end of the floss is being pulled and advanced through the discharge opening. Of course, it should be emphasized that as used herein, the term spool should not be construed as being limited to a reel structure having an elongated segment of floss wound thereabout, and that such term is also deemed by the inventor herein to encompass an elongated segment of floss wound about itself, as in the manner of a ball of string.

To protect the cutter and floss, and/or to obscure the same from view, a cover or lid 60 may be attached, as by a living hinge, to the second section. As best seen by comparing FIG. 2 with FIGS. 1 or 3, such a lid may be readily manipulated between a first position exposing the cutter 36 and free end of dental floss 19 (FIG. 1 or 3) and a second position in which lid 60 is snap fit into engagement over second section 42. In accordance with an especially preferred embodiment of the present invention, the upper surface 62 of lid 60 is formed with an undularing contour representative of the upper surface of a health human tooth. Preferably, and as best seen in FIG. 1, the lower exterior surfaces of first section 40 are also provided with an external contour so as to be representative of the root portion of a healthy human tooth. In FIG. 1, the latter is achieved by utilizing downwardly diverging lateral side wall portions 64, 66 and tapered forward and rear wall portions 68 and 70, as well as arcuate recesses (only one of which, generally indicated by reference numeral 72 is shown in FIG. 1), in the lateral side wall portions 64, 66. A distinct advantage of using the representation of a healthy tooth is that such an appearance serves as a conspicuous reminder to the owner of storage cap 10 that brush and flossing are prerequisites to the preservation of healthy teeth and gums.

While the invention has been shown with respect to a preferred embodiment of the invention, the specific configurations that have been illustrated and described in detail herein are merely exemplary. Various modifications, equivalents and alternatives are contemplated by the inventor and should be considered to fall within the scope of the appended claims.

What is claimed is:

1. For use with a toothbrush having bristles and a graspable handle, a reusable toothbrush storage cap for protecting the bristles, the storage cap comprising:

a first compartment dimensioned and arranged to receive and substantially enclose bristles of a toothbrush while leaving at least a proximal portion of the graspable handle exposed to permit maintenance of the toothbrush in a substantially vertical position when the proximal portion is inserted into an aperture of a stationary toothbrush holder;

a second compartment separated from the first compartment by a partition wall, said second compartment being dimensioned and arranged to receive a spool of dental floss, and having a second wall defining an opening for the egress of floss from within said second compartment; and a cutting element dimensioned and arranged relative to the opening to sever a segment of the floss withdrawn from the compartment, wherein the first compartment is defined by a first section of the storage cap and wherein the second compartment is defined by a second section of the storage cap, the first and second sections being hingedly coupled to permit access to the second compartment for replacement of a spool of dental floss.

2. The storage cap of claim 1, wherein said first and second compartments are arranged such that said second compartment is disposed above said first compartment when the storage cap is positioned on a toothbrush in said substantially vertical position.

3. The storage cap of claim 2, wherein an upper surface of the partition wall defines a bottom surface of the second compartment and a bottom surface of the partition wall defines an upper surface of the first compartment.

4. The storage cap of claim 1, further comprising a lid securable to the second section, said lid being manipulable between a first position covering at least the opening and cutter and a second position exposing the opening and cutter to thereby permit removal of a segment of dental floss.

5. The storage cap of claim 4, wherein the lid is attached to the second section by a living hinge.

6. The storage cap of claim 4, wherein an upper exterior surface portion of the lid has a contour representative of an upper surface of a healthy human tooth.

7. The storage cap of claim 6, wherein exterior sidewall surface portions of the first section have a contour representative of a lower surface of a healthy human tooth.

8. A system for promoting dental hygiene comprising, in combination:

a toothbrush having bristles and a graspable handle;

a spool of dental floss; and a storage cap for promoting brushing and flossing, the storage cap including:

a first compartment dimensioned and arranged to receive and substantially enclose said bristles of the toothbrush while leaving at least a proximal portion of the graspable handle exposed to permit maintenance of the toothbrush in a substantially vertical position when the proximal portion is inserted into an aperture of a stationary toothbrush holder;

a second compartment separated from the first compartment by a partition wall, said second compartment being dimensioned and arranged to receive the spool of dental floss, and having a second wall defining an opening for the egress of floss from within said second compartment; and a cutting element dimensioned and arranged relative to the opening to sever a segment of the floss withdrawn from the compartment, wherein the first compartment is defined by a first section of the storage cap and wherein the second compartment is defined by a second section of the storage cap, the first and second sections being hingedly coupled to permit access to the second compartment for replacement of a spool of dental floss.

9. The system of claim 8, wherein said first and second compartments are arranged such that said second compartment is disposed above said first compartment when the storage cap is positioned on the toothbrush in said substantially vertical position.

10. The system of claim 8, further comprising a lid securable to the second section, said lid being manipulable between a first position covering at least the opening and cutter and a second position exposing the opening and cutter to thereby permit removal of a segment of dental floss from the spool.

11. The system of claim 10, wherein the lid is attached to the second section by a living hinge.

12. The system of claim 10, wherein an upper exterior surface portion of the lid has a contour representative of an upper surface of a healthy human tooth.

13. The system of claim 12, wherein exterior sidewall surface portions of the first section have a contour representative of a lower surface of a healthy human tooth.

14. A method of practicing dental hygiene comprising the steps of:

providing a dental hygiene system for promoting brushing and flossing, the system including including a toothbrush having bristles and a graspable handle a spool of dental floss, and a storage cap having a first compartment substantially enclosing the bristles while leaving at least a proximal portion of the graspable handle exposed to permit maintenance of the toothbrush in a substantially vertical position when the proximal portion is inserted into an aperture of a stationary toothbrush holder, a second compartment separated from the first compartment by a partition wall, the second compartment containing the spool of dental floss, and having a second wall defining an opening for the egress of floss from within the second compartment; and a cutting element dimensioned and arranged relative to the opening to sever a segment of dental loss withdrawn from the compartment;

while grasping the handle of the toothbrush, removing the storage cap to expose the bristles to thereby allow use of the toothbrush;

after use of the toothbrush, replacing the storage cap over the bristles; and inserting the proximal portion of the toothbrush into an aperture of a stationary tootbrush holder.

15. The method of claim 14, further including a step of withdrawing a portion of dental floss through the opening and cutting the portion with the cutter to thereby provide a segment for use in flossing.

* * * * *